US008381612B2

(12) United States Patent
Hisada et al.

(10) Patent No.: US 8,381,612 B2
(45) Date of Patent: Feb. 26, 2013

(54) DIAL DEVICE

(75) Inventors: Masahito Hisada, Aichi (JP); Koichi Nishimura, Aichi (JP); Satoshi Ogawa, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 449 days.

(21) Appl. No.: 12/603,895

(22) Filed: Oct. 22, 2009

(65) Prior Publication Data

US 2010/0101363 A1 Apr. 29, 2010

(30) Foreign Application Priority Data

Oct. 24, 2008 (JP) ..... P2008-274275

(51) Int. Cl.
*G05G 1/08* (2006.01)

(52) U.S. Cl. ..... 74/507

(58) Field of Classification Search ..... 74/53, 503, 74/504, 507, 553; 454/69; 165/41, 42; 16/441; 200/336, 564, 565
See application file for complete search history.

(56) References Cited

U.S. PATENT DOCUMENTS

| | | | | |
|---|---|---|---|---|
| 6,667,446 | B1 * | 12/2003 | Schuberth et al. | 200/4 |
| 7,163,455 | B2 | 1/2007 | Ogawa et al. | |
| 7,381,128 | B2 * | 6/2008 | Ogawa et al. | 454/69 |
| 2005/0064807 | A1 | 3/2005 | Ogawa et al. | |
| 2005/0064808 | A1 | 3/2005 | Ogawa et al. | |
| 2005/0098642 | A1 * | 5/2005 | Ogawa et al. | 237/12 |
| 2007/0029181 | A1 * | 2/2007 | Ogawa | 200/336 |

FOREIGN PATENT DOCUMENTS

| | | | |
|---|---|---|---|
| CN | 1601427 | A | 3/2005 |
| JP | 2002-002259 | A | 1/2002 |
| JP | 2004-217064 | A | 8/2004 |
| JP | 2005-96581 | A | 4/2005 |
| JP | 2006227873 | A * | 8/2006 |
| JP | 2007-299602 | | 11/2007 |

OTHER PUBLICATIONS

Office Action from Japanese Patent Office mailed May 8, 2012 in Japanese counterpart application.
Notification of First Office Action (and English translation) from the State Intellectual Property Office of the People's Republic of China dated Feb. 27, 2012 in Chinese counterpart application.

* cited by examiner

*Primary Examiner* — Vicky Johnson
(74) *Attorney, Agent, or Firm* — Morgan, Lewis & Bockius LLP

(57) ABSTRACT

A dial device includes a body, a first dial knob supported to the body so as to rotate around a predetermined axis, a second dial knob supported to the body so as to rotate around the predetermined axis, and the second dial knob being provided so as to surround the first dial knob, a gear which rotates in response to a rotation of the second dial knob, and is provided on the body, and a pulley unit which includes a first pulley having a connection portion and a second pulley having a gear portion, the second pulley being arranged coaxially with the first pulley. The connection portion of the first pulley is connected to the first dial knob and the gear portion of the second pulley is meshed with the gear in a state that the pulley unit is attached to the body.

4 Claims, 5 Drawing Sheets

DIAL DEVICE

BACKGROUND

The present invention relates to a dial device for transmitting the rotation of each of double-dial knobs to each pulley of a pulley unit.

A dial device described in JP-A-2007-299602 has been proposed. A design portion is located at a central portion of the related dial device. Also, a dial knob is provided so as to surround the design portion and is rotationally operated.

In such a configuration of the related dial device, a pulley which rotates in response to the rotation of the dial knob is provided coaxially with the dial knob as a means for transmitting the rotation of the dial knob to a switch device provided at a position distant from the dial knob. The rotation of the pulley is transmitted to the switch device via a switch.

Meanwhile, the applicant of the present application has devised a dial device having double dial knobs configured so that one dial knob is surrounded by the other dial knob. However, pulley units are purchased from other companies than the applicant's company. Accordingly, in order to make the pulley units compatible with the double dial knobs, it is necessary to configure each pulley unit so that two pulleys of the each pulley unit are placed in backward and forward positions. However, it is difficult to respectively connect the double dial knobs to the two pulleys placed in backward and forward positions and coaxially with each other.

SUMMARY

The invention is accomplished in view of the above circumstances. An object of the invention is to provide a dial device capable of easily connecting double knobs to a pulley unit having two pulleys which are coaxially arranged with each other.

In order to achieve the above object, according to the present invention, there is provided a dial device, comprising:

a body;

a first dial knob supported to the body so as to rotate around a predetermined axis;

a second dial knob supported to the body so as to rotate around the predetermined axis, and the second dial knob being provided so as to surround the first dial knob;

a gear which rotates in response to a rotation of the second dial knob, and is provided on the body; and a pulley unit which includes a first pulley having a connection portion and a second pulley having a gear portion, the second pulley being arranged coaxially with the first pulley, wherein the connection portion of the first pulley is connected to the first dial knob and the gear portion of the second pulley is meshed with the gear in a state that the pulley unit is attached to the body.

Preferably, the gear and the gear portion of the second pulley transmit the rotation of the second dial knob to the second pulley at a speed reduction ratio of 1.

According to the present invention, there is also provided a dial device, comprising:

a body;

a first dial knob supported to the body so as to rotate around a predetermined axis;

a second dial knob supported to the body so as to rotate around the predetermined axis, and the second dial knob being provided so as to surround the first dial knob;

a first gear which rotates in response to a rotation of the first dial knob, and is provided on the body;

a second gear which rotates in response to a rotation of the second dial knob, and is provided on the body; and a pulley unit which includes a first pulley having a first gear portion and a second pulley having a second gear portion, the second pulley being arranged coaxially with the first pulley, wherein the first gear portion of the first pulley is meshed with the first gear and the second gear portion of the second pulley is meshed with the second gear in a state that the pulley unit is attached to the body.

Preferably, the first gear and the first gear portion of the first pulley transmit the rotation of the first dial knob to the first pulley at a speed reduction ratio of 1. The second gear and the second gear portion of the second pulley transmit the rotation of the second dial knob to the second pulley at a speed reduction ratio of 1.

By the above configuration, when the pulley unit, in which the first pulley and the second pulley are provided coaxially with each other, is attached to the body, the connection portion of the first pulley is connected to the first dial knob. Thus, when the first dial knob is rotated, the rotation of the first dial knob is transmitted directly to the first pulley. Consequently, the first pulley is rotated.

On the other hand, the gear portion of the second pulley is meshed with the gear which rotates due to the rotation transmitted from the second dial knob. Thus, when the second dial knob is rotated, the rotation of the second dial knob is transmitted to the second pulley via the gear. Consequently, the second pulley is rotated.

Accordingly, a transmission path from each of the first dial knob and the second dial knob to an associated one of the first pulley and the second pulley can be formed only by attaching the pulley unit to the body.

Also, by the above configuration, the rotation of the second dial knob can be transmitted to the second pulley at a speed reduction ratio of 1, similarly to the case of connecting the rotation of the second dial knob directly to the second pulley using a gear mechanism.

Also, by the above configuration, when the pulley unit, in which the first pulley and the second pulley are provided coaxially with each other, is attached to the body, the first gear of the first pulley is meshed with the first gear which rotates due to the rotation transmitted from the first dial knob. Thus, when the first dial knob is rotated, the rotation of the first dial knob is transmitted to the first pulley via the first gear. Consequently, the first pulley is rotated.

On the other hand, when the gear of the second pulley is meshed with the second gear which rotates due to the rotation transmitted from the second dial knob. Thus, when the second dial knob is rotated, the rotation of the second dial knob is transmitted to the second pulley via the second gear. Consequently, the second pulley is rotated.

Accordingly, a transmission path from each of the first dial knob and the second dial knob to an associated one of the first pulley and the second pulley can be formed only by attaching the pulley unit to the body.

Also, by the above configuration, the rotations of the first and second dial knobs can be transmitted to the first and second pulleys at a speed reduction ratio of 1, similarly to the case of connecting the rotations of the first and second dial knobs directly to the first and second pulleys using a gear mechanism.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

First Embodiment

Figure 1:
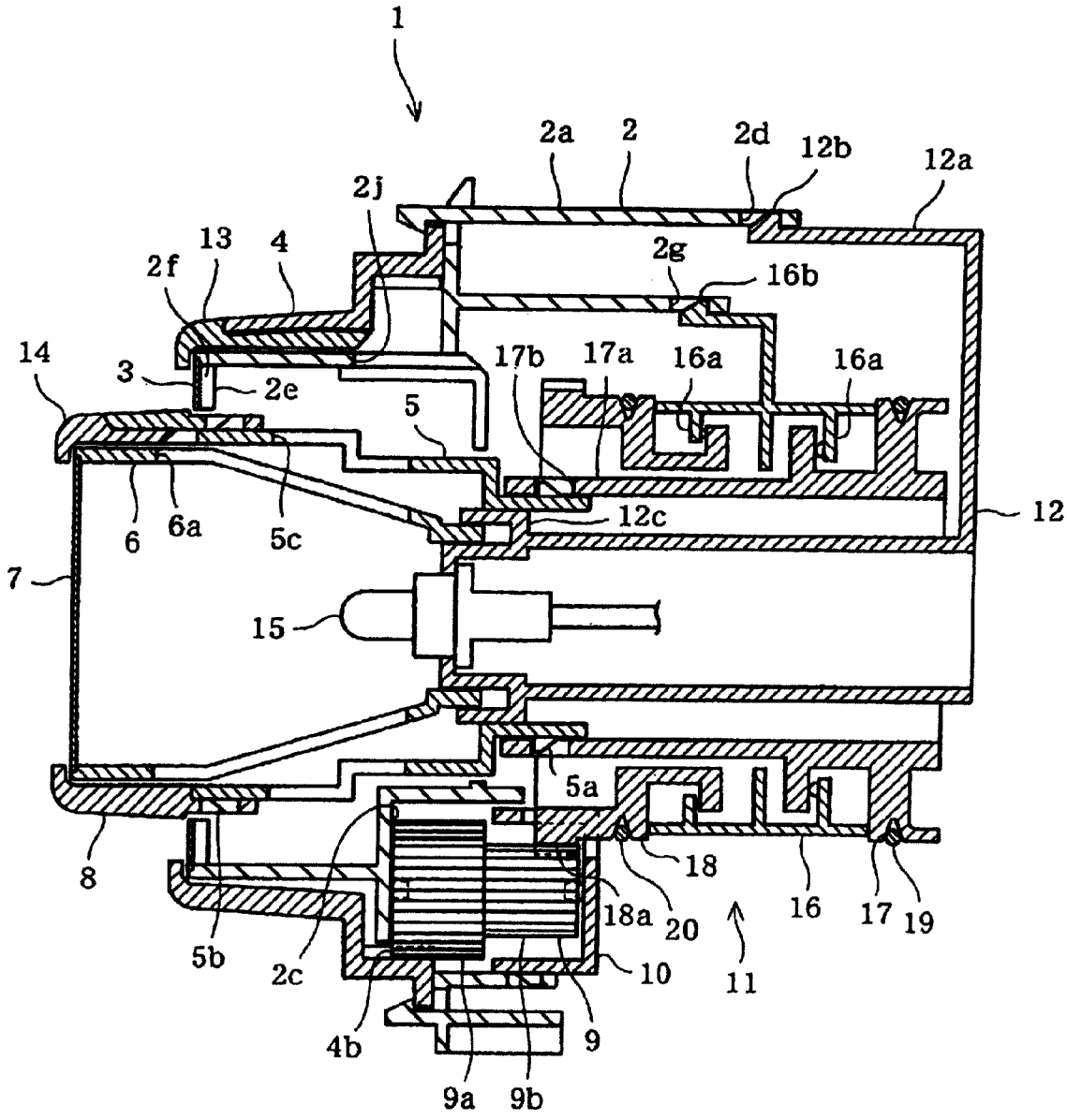
FIG. 1 is a longitudinally cross-sectional view schematically illustrating a dial device according to a first embodiment of the invention.
Figure 2:
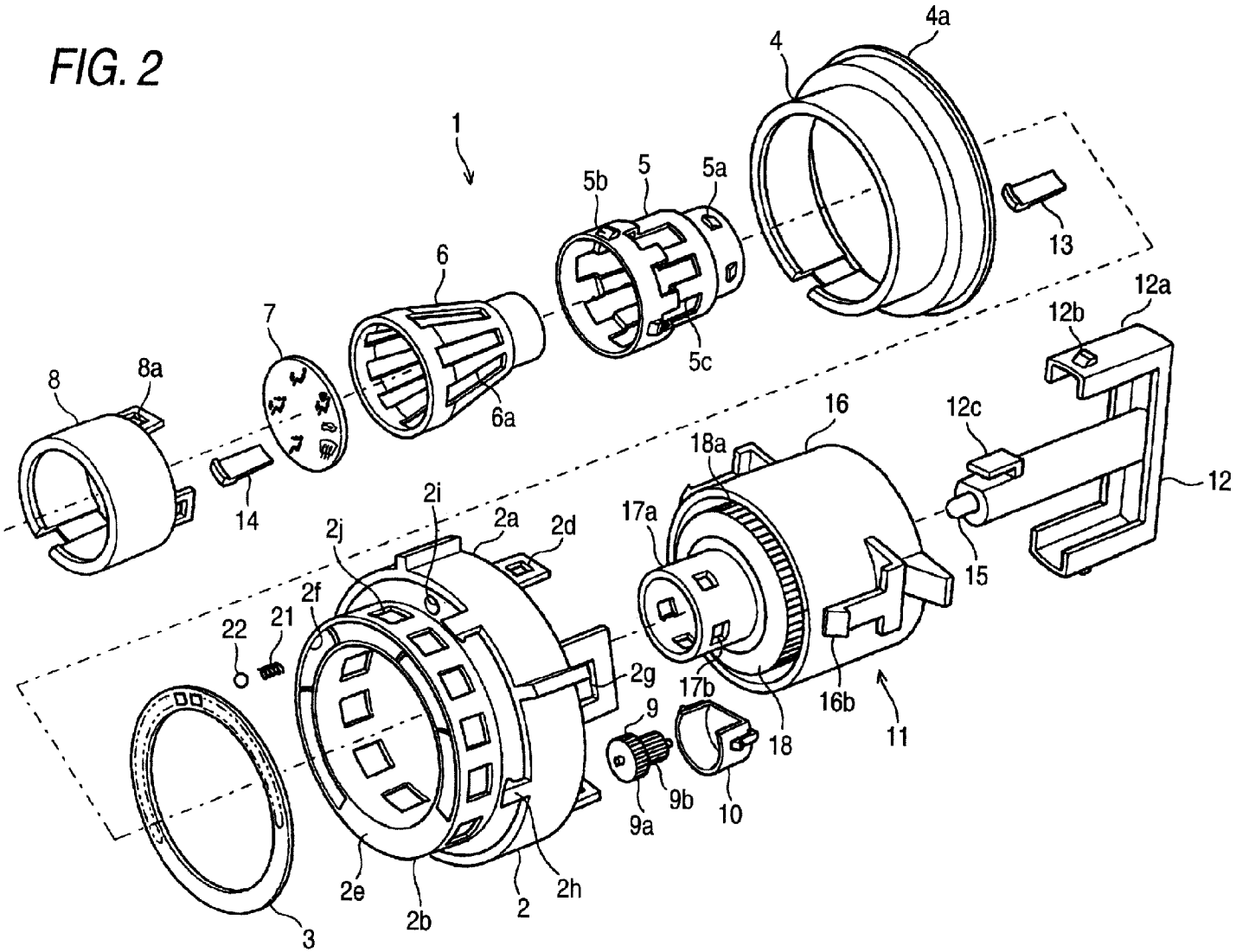
FIG. 2 is a perspective view illustrating the dial device according to the first embodiment of the invention in an exploded manner.

Hereinafter, a first embodiment in which the invention is applied to a heater control dial is described with reference to FIGS. 1 to 3. FIG. 1 is a longitudinally cross-sectional view roughly illustrating the entire of the dial device according to the first embodiment of the invention. FIG. 2 is a perspective view illustrating the entire of the dial device according to the first embodiment of the invention in an exploded manner.

The dial device 1 is configured by assembling the following components to a body 2. That is, an air-mixing (hereinafter referred to as "A/M") panel 3, an A/M dial knob (corresponding to a second dial knob) 4, a MODE rotor 5, a MODE bezel 6, a MODE panel 7, and a MODE dial knob (corresponding to a first dial knob) 8 are attached to the body 2 from a front surface of the body 2. In addition, a gear 9, a cover 10, a pulley unit 11, and a lamp holder 12 are attached to the body 2 from a rear surface of the body 2. An A/M pointer lens 13 is attached to the A/M dial knob 4. A MODE pointer lens 14 is attached to the MODE dial knob 8. A lamp 15 is attached to the lamp holder 12.

The body 2 is fixed to the vehicle side and includes a columnar body portion 2*a* and a cylindrical support portion 2*b* formed on the front surface side of the body portion 2*a* integrally therewith. A gear housing portion 2*c* is formed on the rear surface of the body portion 2*a*. The cover 10 is attached to the gear housing portion 2*c* while the gear 9 is housed in the gear housing portion 2*c*. Thus, the gear 9 is rotatably attached to the body 2. The gear 9 includes a large gear portion 9*a* and a small gear portion 9*b*. The lamp holder 12 is attached to the body 2 by engaging engagement convex portions 12*b* formed on both arm portions 12*a* with engagement hole portions 2*d* formed in the body 2, respectively.

A flange-like receiving portion 2*e* is formed on the front surface of the support portion 2*b* of the body 2. The A/M panel 3 is attached to the front surface of the receiving portion 2*e*. A plurality of window portions 2*f* are formed in the receiving portion 2*e*. The window portions 2*f* constitute optical paths for light emitted from the lamp 15 towards the A/M panel 3.

The pulley unit 11 is configured by assembling a MODE pulley (corresponding to the first pulley) 17 to the pulley unit 11 from the rear surface side of a cylindrical pedestal 16 and by assembling an A/M pulley (corresponding to the second pulley) 18 to the pulley unit 11 from the front surface of the cylindrical pedestal 16. In this case, the support portion 16*a* is formed integrally with the inner peripheral portion of the cylindrical pedestal 16. The pulleys 17 and 18 are rotatably supported on the support portion 16*a*. An engagement shaft 17*a* is formed integrally with the MODE pulley 17. The engagement shaft 17*a* is passed through the pedestal 16 and projected frontwardly. A plurality of engagement hole portions (corresponding to the connection portions) 17*b* are formed in the front end part of the engagement shaft 17*a*. A gear portion 18*a* is formed integrally with the A/M pulley 18. Each of wires 19 and 20 is wound around an associated one of the MODE pulley 17 and the A/M pulley 18. The wires 19 and 20 are drawn out of the pedestal 16 and connected to a switch device (not shown).

A ball urged by a compression coil spring (not shown) abuts against a detent portion (not shown) formed on the front surface of the MODE pulley 17. Detent is applied to the MODE pulley 17 at a predetermined rotational position.

An engagement claw portion 16*b* formed on the pedestal 16 is engaged with an engagement hole portion 2*g* formed on the body 2. Consequently, the pulley unit 11 is attached to the body 2.

The A/M dial knob 4 has a flange portion 4*a* and is cylindrically shaped. The A/M pointer lens 13 is fixed to the inner peripheral surface of the A/M pointer lens 13. The A/M dial knob 4 is latched with a latch claw portion 2*h* formed on the front surface of the body portion 2*a* of the body 2. Consequently, the A/M dial knob 4 is rotatably attached to the body 2. A gear portion 4*b* is formed on the inner peripheral surface of the A/M dial knob 4. The gear portion 4*b* meshes with the large gear portion 9*a* of the gear 9 attached to the body 2.

A hole portion 2*j* is formed in the body portion 2*a* of the body 2. A ball 22 urged by the compression coil spring 21 that is housed in the hole portion 2*j* abuts against a detent portion (not shown) formed on the rear surface of the A/M dial knob 4. Detent is applied to the A/M dial knob 4 at a predetermined rotational position.

The cylindrical MODE rotor 5 is inserted into the inside of the A/M dial knob 4. The engagement claw portion 5*a* formed integrally with the MODE rotor 5 engages with the engagement hole portion 17*b* formed in the front end part of the engagement shaft 17*a* of the MODE pulley 17. Consequently, the MODE rotor 5 is connected to the MODE pulley 17. The gear portion 18*a* of the A/M pulley 18 engages with the small gear portion 9*b* of the gear 9 at the side of the body 2 to thereby form a transmission path from the MODE rotor 5 to the MODE pulley 17.

In a state that the MODE bezel 6 and the MODE panel 7 are inserted into the MODE rotor 5, the engagement hole portion 8*a* formed in a MODE dial knob 8 is engaged with an engagement claw portion 5*b* formed on the MODE rotor 5. Consequently, the MODE dial knob 8 is connected to the MODE pulley 17 via the MODE rotor 5. In this state, a rear portion of the MODE bezel 6 is engaged with an engagement portion 12*c* formed in the front end part of the lamp holder 12. The MODE bezel 6 is formed integrally with the body 2 via the lamp holder 12.

The MODE dial knob 8 is connected to the MODE pulley 17 via the MODE rotor 5. Thus, the MODE pulley 17 is rotated in response to the rotation of the MODE dial knob 8. On the other hand, the A/M dial knob 4 is connected to the A/M pulley 18 via the gear mechanism. Thus, the A/M pulley 18 is rotated in response to the rotation of the A/M dial knob 4. The rotation of each of the MODE pulley 17 and the A/M pulley 18 is transmitted to the switch device (not shown) by the wires 19 and 20. Consequently, an operation of a car air-conditioner is controlled.

A plurality of window portions 6*a* are formed in the bezel 6. A plurality of window portions 5*c* are formed in the MODE rotor 5. The plurality of window portions 2*j* are formed in the support portion 2*b* of the body 2. An optical path extending from the lamp 15 towards the pointer lens, i.e., the A/M pointer lens 13 or the MODE pointer lens 14 is formed.

Figure 3:
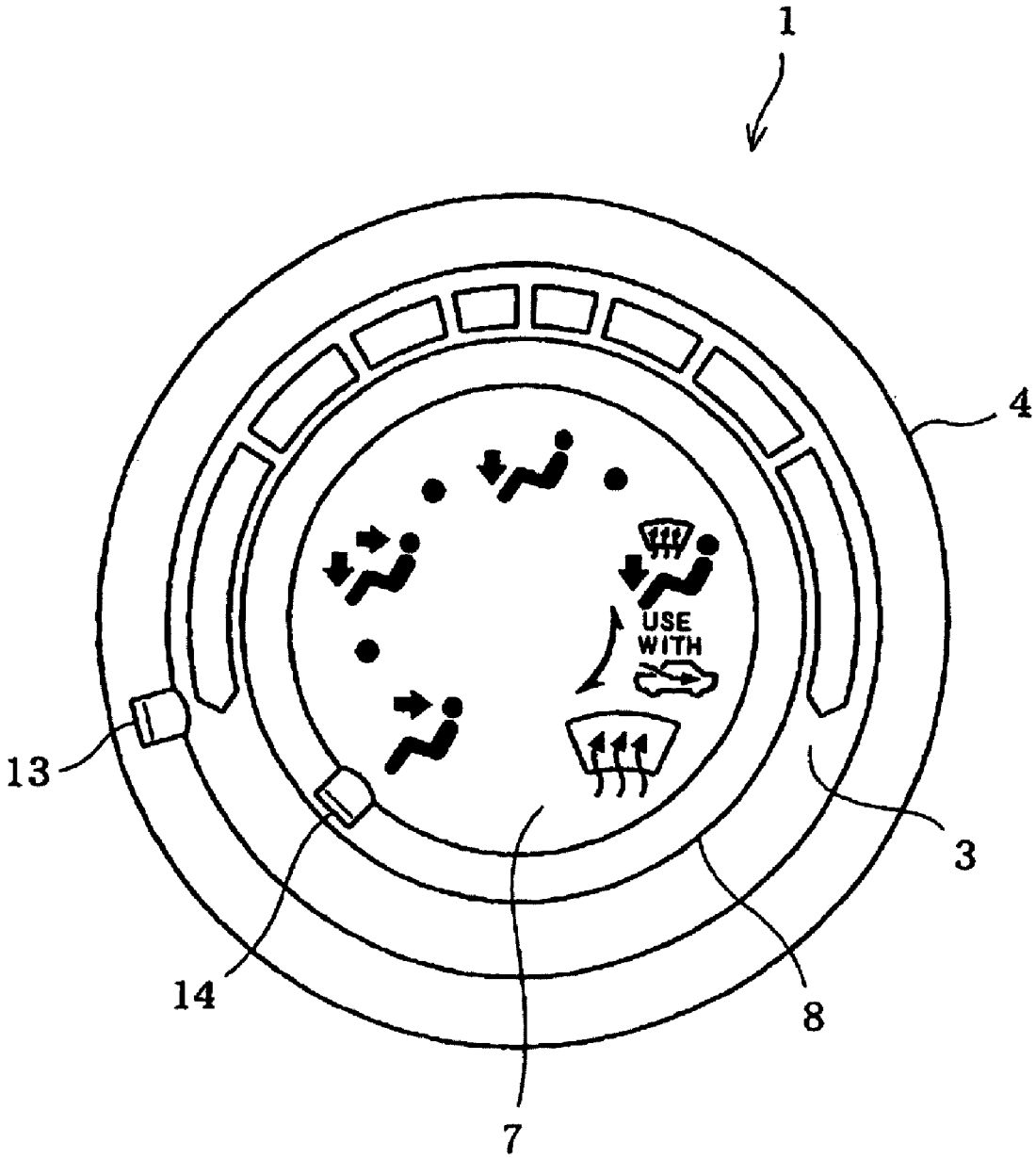
FIG. 3 is a plan view illustrating a dial knob of the dial device.

With the above configuration, the MODE dial knob 8 is rotatably provided to surround the MODE panel 7, and the A/M dial knob 4 is rotatably disposed to surround the MODE dial knob 8, as illustrated in FIG. 3 illustrating a plan view of each of the dial knobs 4 and 8. The rotational position of each of the A/M dial knob 4 and the MODE dial knob 8 is indicated by the position of each of the pointer lenses 13 and 14. In a state that the lamp 15 is turned on, light emitted from the lamp 15 is irradiated onto the rear end surface of each of the pointer lenses 13 and 14. Thus, light is passed through each of the pointer lenses 13 and 14 and irradiated onto a mark design part of each of the panels 3 and 7 from the front end surface of each of the pointer lenses 13 and 14.

According to such an embodiment, when the pulley unit 11 is attached to the body 2, the engagement shaft 17*a* of the MODE pulley 17 in the pulley unit 11 is connected to the MODE rotor 5 that is connected to the MODE dial knob 8. In addition, the gear portion 18*a* of the A/M pulley 18 mesh with the gear 9 which rotates in response to the rotation of the A/M dial knob 4. Thus, although the configuration of the dial device employs the Pulley unit 11 in which the pulleys 17 and 18 are coaxially provided, a transmission path extending from each of the MODE dial knob 8 and the A/M dial knob 4 to an associated one of the MODE pulley 17 and the A.M pulley 18 can be formed. Accordingly, the double dial knobs 4 and 8 can easily be connected to the pulley unit 11 including and the two pulleys 17 and 18 placed coaxially with each other.

In addition, a gear mechanism including mainly the gear 9 is configured so that the rotation of the A/M dial knob 4 is transmitted to the A/M pulley 18 at a reduction speed ratio of 1. Thus, the rotation of the A/M dial knob 4 can be transmitted to the pulley, similarly to the configuration in which the A/M dial knob 4 is connected directly connected to the A/M pulley 18.

Second Embodiment

A second embodiment of the invention is described below with reference to FIGS. 4 and 5. The second embodiment is featured in that the rotation of each of double dial knobs is transmitted to an associated one of pulleys.

Figure 4:
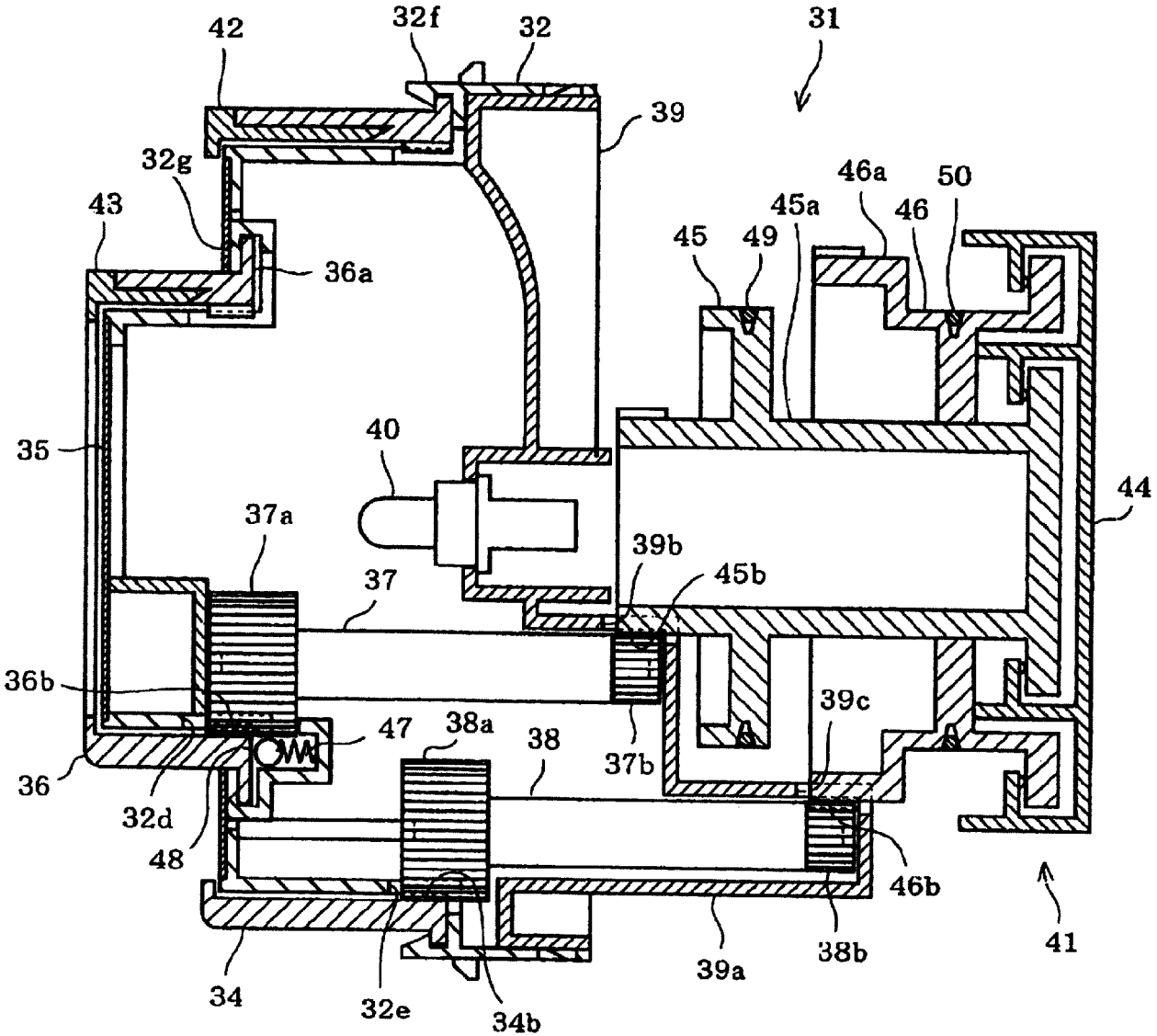
FIG. 4 is a diagram illustrating a dial device according to a second embodiment of the invention.
Figure 5:
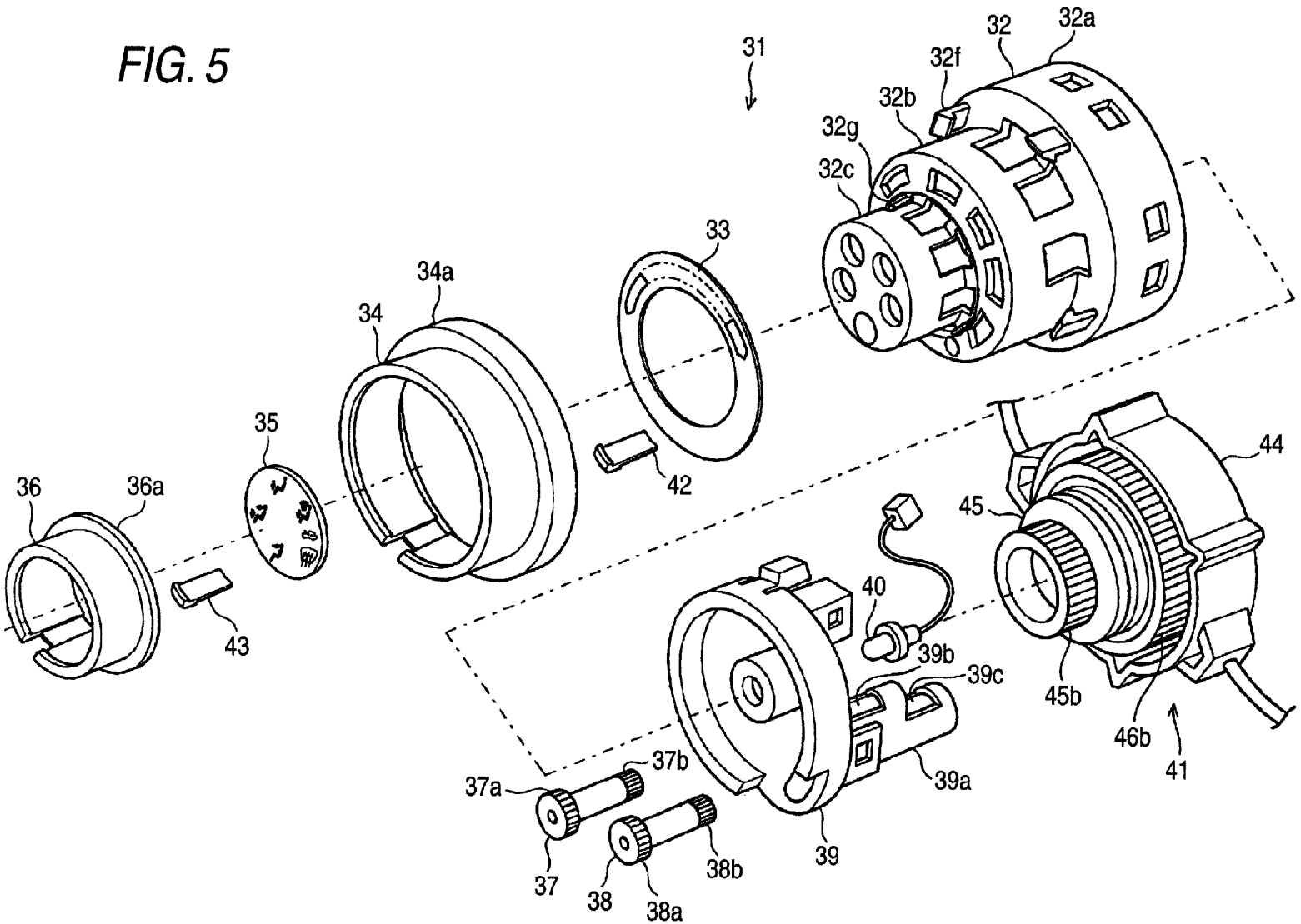
FIG. 5 is a perspective view illustrating the dial device according to the second embodiment of the invention in an exploded manner.

FIG. 4 is a longitudinally cross-sectional diagram schematically illustrating the entire of a dial device according to the second embodiment of the invention. FIG. 5 is an exploded perspective view roughly illustrating the entire of the dial device according to the second embodiment. A dial device 31 is configured by assembling the following components to the body. That is, an A/M panel 33, an A/M dial knob 34, a MODE rotor 35, and a MODE bezel 36 are attached to the body 32 from the front surface of the body 32. In addition, a MODE gear (corresponding to the first gear) 37, an A/M gear (corresponding to the second gear) 38, a cover 39, a lamp unit 40, and a pulley unit 41 are attached to the body 32 from the rear surface of the body 32. An A/M pointer lens 42 is attached to the A/M dial knob 34. A MODE pointer lens 43 is attached to the MODE dial knob 36.

The body 32 has a large-diameter A/M support portion 32*b* and a small-diameter MODE support portion 32*c* which are formed integrally with the front surface of the body portion 32*a*. In the body 32, the MODE gear 37 is rotatably supported at the position inside MODE support portion 32*c*. The A/M gear 38 is rotatably supported in a state that the A/M gear 38 is housed in a housing portion 39*a* formed integrally with the cover 39. The gear 37 includes a large-diameter first gear portion 37*a* and a small-diameter second gear portions 37*b*. The gear 38 includes a large-diameter first gear portion 38*a* and a small-diameter second gear portions 3*b*. The first gear portion 37*a* of the MODE gear 37 faces externally from a window portion 32*d* formed in the MODE support portion 32*c*. The second gear portion 37*b* faces externally from the window portion 32*e* formed in the A/M support portion 32*b* of the body 32. The first gear portion 38*a* of the A/M gear 38 faces inwardly from the window portion 39*b* formed in the housing portion 39*a* of the cover 39. The second gear portion 38*b* faces inwardly from the window portion 39*c*.

The pulley unit 41 is constructed such that the MODE pulley 45 is rotatably attached to a pedestal 44, and that an A/M pulley 46 is rotatably attached to the pedestal 44 to surround the support shaft 45*a* of the MODE pulley 45. A gear portion (corresponding to the first gear portion) 45*b* is formed on the front end outer peripheral portion of the MODE pulley 45. The gear portion 45*b* meshes with the second gear portion 37*b* of the MODE gear 37. A gear portion (corresponding to the second gear portion) 46*b* is formed on the front end outer peripheral part of an extension portion 46*a* of the A/M pulley 46. The gear portion 46*b* meshes with the second gear portion 38*b* of the A/M gear 38.

The flange portion 34*a* of the A/M dial knob 34 engages with the engagement claw portion 32*f* formed on the body portion 32*a* of the body 32. Consequently, the A/M dial knob 34 is attached to the body 32 so as to surround the A/M support portion 32*b*. In this state, the gear portion 34*b* formed on the inner periphery of the A/M dial knob 34 meshes with the first gear portion 38*a* of the A/M gear 38.

An engagement claw portion 32*g* is formed on the A/M support portion 32*b* of the body 32. The flange portion 36*a* formed on the MODE dial knob 36 engages with the engagement claw portion 32*g*. Consequently, the MODE dial knob 36 is attached to the body 32 in a slip-off preventing state to surround the MODE support portion 32*c*. In this state, the gear portion 36*b* formed on the inner periphery of the MODE dial knob 36 meshes with the first gear portion 37*a* of the MODE gear 37. In this case, the gear ratio of each of the gears is set such that the rotation of each of the dial knobs 34 and 36 is transmitted to an associated one of the pulleys 45 and 46 at a speed reduction ratio of 1.

A ball 50 urged by a compression coil spring 49 attached to the body 32 abuts against each of the dial knobs 34 and 36. Thus, detent is applied to each of the dial knobs 34 and 36 at a predetermined rotational position.

Each of the wires 49 and 50 is wound around an associated one of the MODE pulley 45 and the A/M pulley 46. The wires 49 and 50 are drawn externally from the pedestal 44 and connected to a switch device (not shown).

With the above configuration, the MODE pulley 45 is rotated in response to the rotation of the MODE dial knob 36, similarly to the case of employing the configuration in which the MODE dial knob 36 is connected directly to the MODE pulley 45. The A/M pulley 46 is rotated in response to the rotation of the A/M dial knob 34, similarly to the case of the configuration in which the A/M dial knob 34 is connected directly to the A/M pulley 46.

According to this embodiment, when the pulley unit 41 is attached to the body 32, each of the gear portions 45*b* and 46*b* at the side of the pulley unit 41 meshes with an associated one of the gears 37 and 38 at the side of the body 32. Although the present embodiment employs the pulley unit 41, a transmission path from each of the MODE dial knob 36 and the A/M dial knob 34 to an associated one of the MODE pulley 45 and the A/M pulley 46 can be formed. Accordingly, similarly to the first embodiment, the double dial knobs 34 and 36 can easily be connected to the pulley unit 41 including the two pulleys 45 and 46 placed coaxially with each other.

In addition, a gear mechanism including mainly the gears 37 and 38 is constructed such that the rotation of each of the dial knobs 34 and 36 is transmitted to an associated one of the pulleys 45 and 46 at a speed reduction gear of 1. Thus, the rotation of each of the dial knobs 34 and 36 can be transmitted to an associated one of the pulleys 45 and 46 using the gear mechanism, similarly to the case of the configuration in which each of the dial knobs 34 and 36 is connected directly to an associated one of the pulleys 45 and 46. In a case where the dial device is configured so that one of the gears 37 and 38 precedingly meshes with the gear portion of the associated knob, preferably, one of the gears 37 and 38 can be prevented from being not meshed with the gear portion of the associated knob due to backlash of each of the gears 37 and 38 when the pulley unit 41 is attached to the body 32. That is, in the case of the configuration in which the gears 37 and 38 simultaneously mesh with the knobs, respectively, backlash can be minimized due to the presence of some play in the gears 37 and 38. Preferably, the gears 37 and 38 can be sequentially meshed with the gear portions of the knobs, respectively. Thus, a worker can mesh the gears with the gear portions of the knobs while checking the engagement between the gear and the gear portion of the associated knob at each engagement therebetween.

Other Embodiments

The invention is not limited to the above embodiments but can be modified or expanded as follows.

The invention is not limited to the double dial knobs but can be applied to triple or more dial knobs.

The invention is not limited to a heater control dial but can be applied to various types of dials.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2008-274275 filed on Oct. 24, 2008, the contents of which are incorporated herein for reference.

What is claimed is:

1. A dial device, comprising:

a body;

a first dial knob supported to the body so as to rotate around a predetermined axis;

a second dial knob supported to the body so as to rotate around the predetermined axis, and the second dial knob being provided so as to surround the first dial knob;

a gear which rotates in response to a rotation of the second dial knob, and is provided on the body; and a pulley unit which includes a first pulley having a connection portion and a second pulley having a gear portion, the second pulley being arranged coaxially with the first pulley, wherein the connection portion of the first pulley is connected axially to the first dial knob and the gear portion of the second pulley is meshed with the gear in a state that the pulley unit is attached to the body;

wherein the second pulley surrounds the first pulley; and wherein a rotation axis of the first dial knob is coaxially arranged with a rotation axis of the first pulley.

2. The dial device according to claim 1, wherein the gear and the gear portion of the second pulley transmit the rotation of the second dial knob to the second pulley at a speed reduction ratio of 1.

3. The dial device according to claim 1, wherein a rotation axis of the second dial knob is coaxially arranged with a rotation axis of the second pulley.

4. The dial device according to claim 1, further comprising:

a bezel being provided in the body, wherein a window portion for passing through a light emitted from a lamp is formed in the bezel.

* * * * *